US005440296A

United States Patent [19]

Nelson

[11] Patent Number: 5,440,296

[45] Date of Patent: Aug. 8, 1995

[54] COIL ASSEMBLY FOR ELECTRONIC ARTICLE SURVEILLANCE SYSTEM

[75] Inventor: John E. Nelson, Woodbury, Minn.

[73] Assignee: Minnesota Mining and Manufacturing Company, St. Paul, Minn.

[21] Appl. No.: 55,689

[22] Filed: Apr. 29, 1993

[51] Int. Cl.[6] ..... G08B 13/14; G08B 13/24; H01Q 21/00

[52] U.S. Cl. ..... 340/572; 343/867; 340/551

[58] Field of Search ..... 340/572, 551; 343/742, 343/867

[56] References Cited

U.S. PATENT DOCUMENTS

| | | | |
|---|---|---|---|
| 3,665,449 | 5/1972 | Elder et al. | 340/280 |
| 3,697,996 | 10/1972 | Elder et al. | 343/101 |
| 4,135,183 | 1/1979 | Heltemes | 340/572 |
| 4,135,184 | 1/1979 | Pruzick | 343/867 X |
| 4,274,090 | 6/1981 | Cooper | 340/572 |
| 4,309,697 | 1/1982 | Weaver | 340/572 |
| 4,326,198 | 4/1982 | Novikoff | 340/572 |
| 4,623,877 | 11/1986 | Buckens | 340/572 |
| 4,994,939 | 2/1991 | Rubertus et al. | 361/429 |

FOREIGN PATENT DOCUMENTS

| | | | |
|---|---|---|---|
| 0130286 | 1/1985 | European Pat. Off. | G08B 13/24 |
| 2133660 | 7/1984 | United Kingdom | H04B 5/00 |

*Primary Examiner*—James J. Groody
*Assistant Examiner*—John W. Miller
*Attorney, Agent, or Firm*—Gary L. Griswold; Walter N. Kirn; Kari H. Bartingale

[57] ABSTRACT

An antenna lattice for use in a magnetically based electronic article surveillance system. The lattice includes a field-producing coil assembly which includes a pair of trapezoidal-shaped segments, each having a diagonally extending lower portion, the segments being juxtaposed in a mirror image so that the diagonal portions are opposite each other. The segments are connected so that vertical components of the currents in the diagonal sections at least partially cancel. Preferably, top horizontal sections of each segment are located at different levels, thereby extending the upper coverage, and a detector coil preferably also juxtaposed extends above the top horizontal section of the field-producing coil to further extend the range of detection.

19 Claims, 8 Drawing Sheets

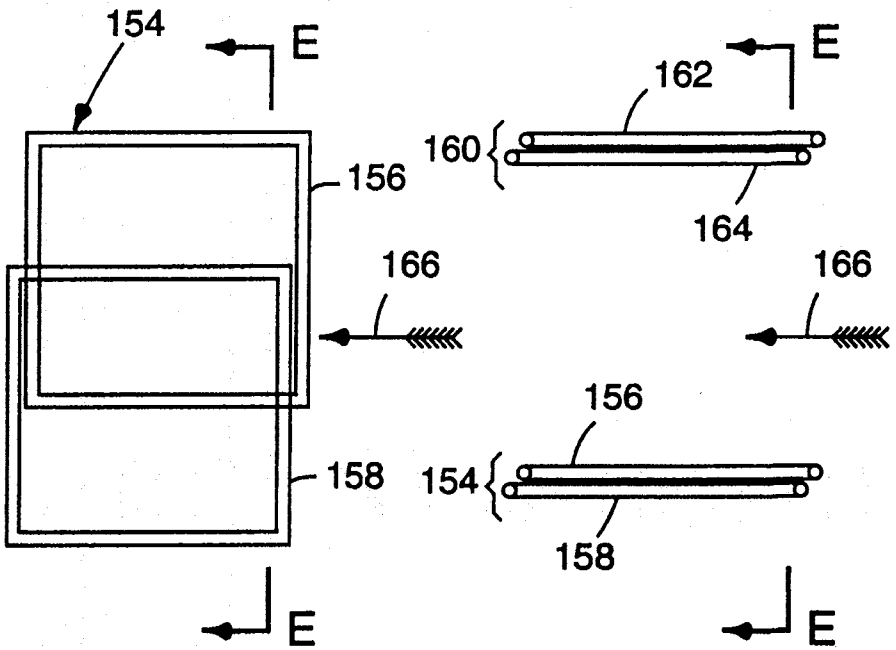
FIG.13B
PRIOR ART
FIG.13C
PRIOR ART
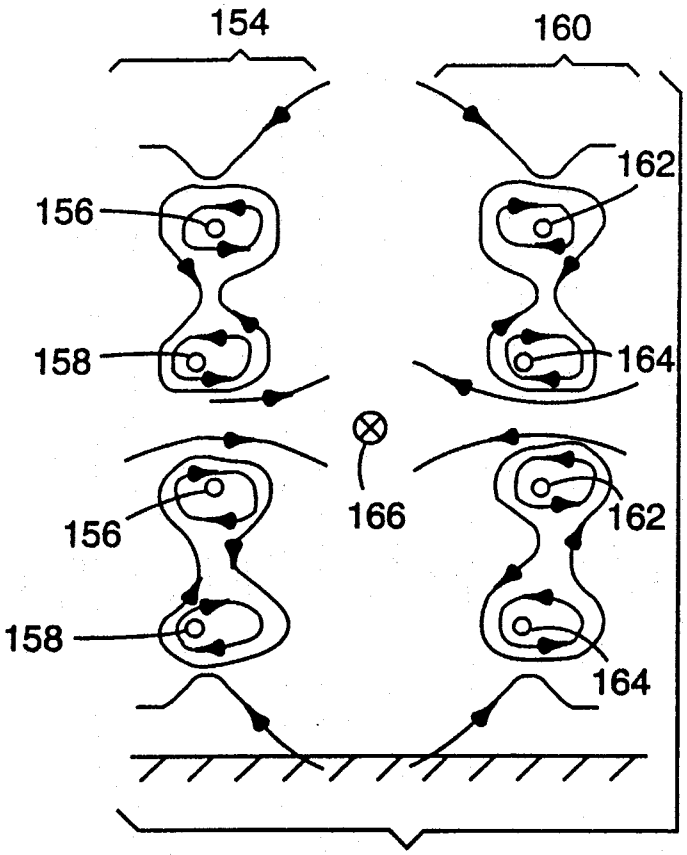
FIG.13A
PRIOR ART

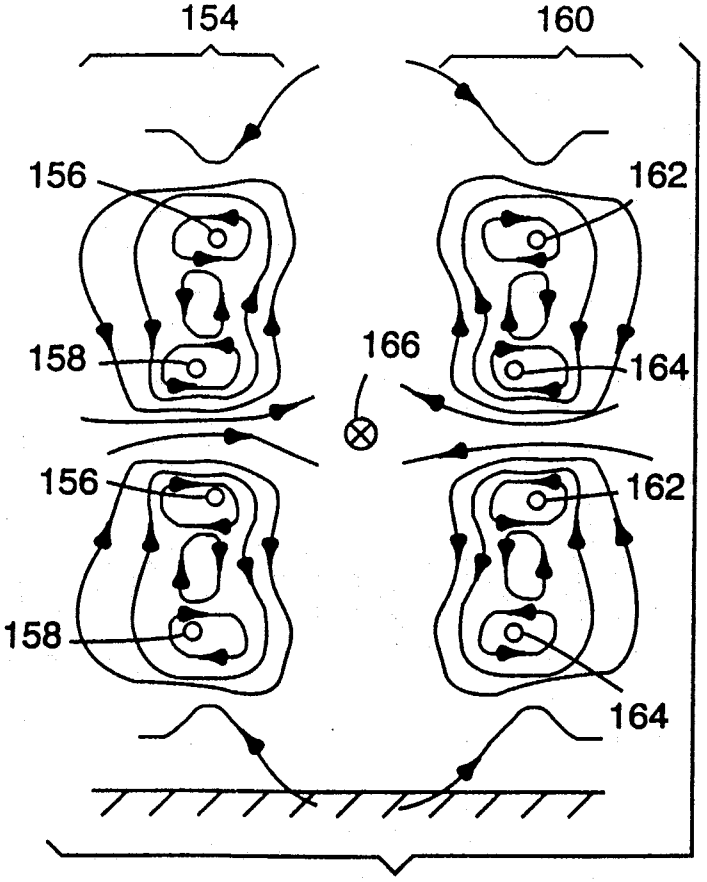
FIG.14A
PRIOR ART
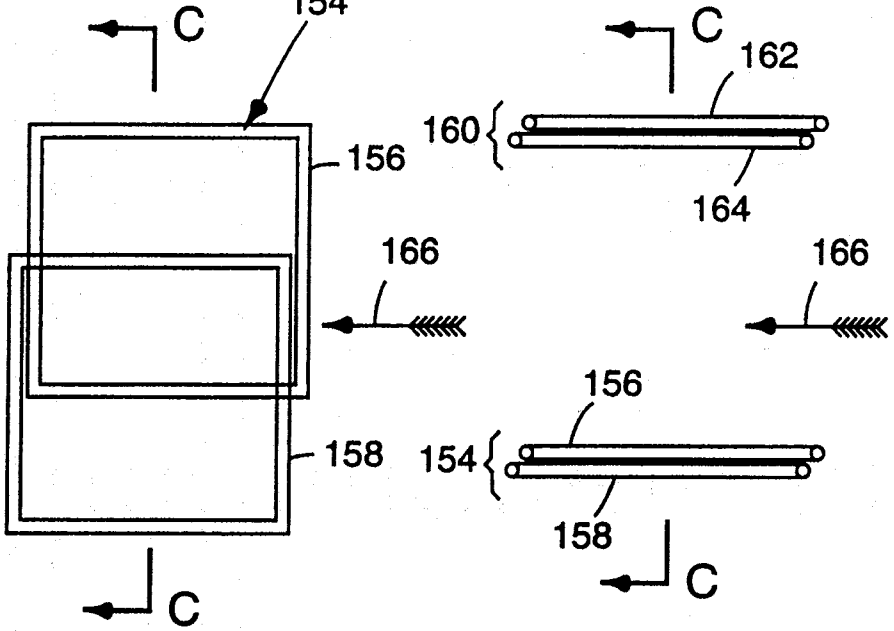
FIG.14B
PRIOR ART
FIG.14C
PRIOR ART

COIL ASSEMBLY FOR ELECTRONIC ARTICLE SURVEILLANCE SYSTEM

TECHNICAL FIELD

This invention relates to electronic article surveillance systems and, in particular, to coil/lattice configurations for producing and detecting magnetic fields in interrogation zones associated with such systems.

BACKGROUND OF THE INVENTION

The initial commercial introduction of magnetically based electronic article surveillance (EAS) systems over twenty years ago included the use of a marker formed of a strip of permalloy about seven inches long, adopted to be concealed within the spine of a book, adhered between pages, etc. The strip was basically detectable only in one direction, hence various techniques were developed to overcome that limitation. Some were directed to the markers themselves, such as the use of more than one marker, positioned at right angles, L or X shaped markers, etc.

Still other techniques were directed to providing interrogation fields extending in various directions such that the markers could be detected regardless of their orientation. Thus, for example, U.S. Pat. Nos. 3,665,449 and 3,697,996 (Elder and Wright) disclose the use of three coils positioned to generate fields in three orthogonal directions, together with electronic circuitry to sequentially energize each of the coils, thereby generating spatially separated fields, each of which extended primarily in one direction so as to enhance the detection of markers oriented so as to be detectable in that direction.

U.S. Pat. No. 4,135,183 (Heltemes) is directed to a different way of providing multidirectional detection. In that patent, it is proposed that complex, hence expensive, systems requiring sequential energization be avoided by providing a pair of coils, each of which is substantially planar, positioned on opposite sides of a corridor defining an interrogation zone therebetween. Both coils have substantially the same overall shape, and are wound in either a Figure-8 or hour-glass configuration. Such coils are said to produce fields that vary significantly in different regions and, thereby, enhance the detectability of markers regardless of orientation in the zone.

Other techniques for providing fields extending in different directions throughout the interrogation zone to enhance the detection of unidirectionally responsive markers regardless of orientation in the zone are discussed in U.S. Pat. Nos. 4,309,697 (Weaver); 4,326,198 (Novikoff); and 4,623,877 (Buckens).

The '697 patent proposes the use of a pair of lattice assemblies positioned parallel with each other, on opposite sides of an interrogation zone extending therebetween. A rhomboid-shaped transmitting, i.e., field-producing, coil is to be positioned within each of the lattices, with the diagonal side of each coil being oppositely directed; e.g., the coil on one side of the zone has its diagonal side directed upward, while the diagonal side of the other coil is directed downward with respect to a desired passageway through the zone. In that patent, it is further proposed that a lazy-8 receiver coil also be positioned parallel with and alongside each transmitting coil.

In contrast, one embodiment depicted in the '198 patent proposes the use of a pair of transmitting coils in one lattice assembly on one side of the zone, and a pair of receiving coils in another lattice assembly positioned parallel with the first lattice, but located on the other side of the zone. In that embodiment, the transmitting coils are in substantially the same plane, are offset both horizontally and vertically, and are connected so that current flows in the same direction in both coils. That embodiment also requires the use of similarly offset DC energized bias coils. While the vertical and horizontal offset facilitates the production of differently directed field components throughout the zone, it requires the use of dual, different lattice assemblies.

The '877 patent depicts another variant. In that patent, a pair of field coils and a pair of receiving coils are all enclosed in a single lattice. The field-producing coils are basically rectangular, with smaller rectangular coils being centered within a larger, more square one. The coils are connected so that current flows in the same direction in both. The lattices are used in pairs on opposite sides of the interrogation zone, and are connected so that current in the coils on one side flows in the opposite direction from that in the coils on the other side, when all are viewed from the same side of the zone.

A lattice assembly bearing some similarity to that adapted to enclose the coil assembly of the present invention is also set forth in U.S. Pat. No. 4,994,939, however, the coil assembly contained within the lattice assembly is not configured to provide extended, multidirectional detection throughout an interrogation zone.

SUMMARY OF THE INVENTION

The coil assembly of the present invention differs significantly from those described above, and includes features resulting in field distributions in an associated interrogation zone which still further enhance the detectability of EAS magnetic markers therein regardless of orientation. The assembly of the present invention thus also includes a field-producing coil which includes at least a pair of substantially similarly configured coil segments juxtaposed in substantially a coplanar orientation. In the present assembly, each segment has a pair of spaced apart and mutually parallel vertical arms, a top, substantially horizontal section connecting the upper ends of the vertical arms, and a bottom, at least partially diagonal section connecting the lower end of the vertical arms.

The respective vertical arms of each segment are spaced apart a like distance such that the segments are substantially juxtaposed. The respective bottom sections of each segment are located at substantially the same level, each having at least a part thereof positioned at an opposite diagonal angle with respect to a similarly positioned part of the bottom section of the other segment.

The segments are connected such that current applied thereto is additive in the top sections so as to produce an intensified magnetic field in the upper half of the coil assembly to enhance the detectability of EAS markers positioned proximate thereto. The field resulting from current in the diagonally positioned bottom sections at least partially cancels and, thus, minimizes interference from electromagnetically active objects proximate a surface on which the said associated EAS system may be positioned. Preferably, top sections of each segment are located at a different, predetermined height, thus producing a vertically extended magnetic field to improve the detection of markers located in upper regions of the zone.

In a further preferred embodiment, the field-producing coil includes at least a pair of substantially similarly configured trapezoidal coil segments positioned alongside each other in substantially a coplanar orientation, each trapezoidal segment having i) a pair of spaced apart and mutually parallel vertical arms terminating at respective upper ends at substantially the same level and having different lengths so as to terminate at respective lower ends at substantially different levels, ii) a top, substantially horizontal section connecting the upper ends of the respective arms, and iii) a bottom section diagonally positioned to connect the lower end of the different length arms.

The pair of coil segments is positioned so that the longer arm of one segment is alongside the shorter arm of the other segment, the lower end of each longer arm is positioned at substantially the same level, and the top horizontal sections are, therefore, positioned at different levels.

In a further preferred embodiment, the coil assembly also includes a detector coil positioned adjacent to and substantially coplanar with the field-producing coil, the detector coil having two sections connected in a lazy Figure-8 configuration. Preferably, each half of the bottom section of the detector coil extends diagonally so as to be adjacent a respective diagonally configured bottom section of the field-producing coil, and the top section of the detector coil extends appreciably above the topmost horizontal section of the field-producing coil so as to detect fringe fields resulting from the field-producing coil.

BRIEF DESCRIPTION OF THE DRAWING

FIGS. 13A, 13B and 13C are front, side and top views of a pair of spaced-apart, prior art, field-producing coils, defining an interrogation coil therebetween, in which FIG. 13A further shows a representation of the vertical field distribution taken at a plane approximately at the entrance to the interrogation zone and perpendicular to the surface on which the coils are mounted;

FIGS. 14A, 14B and 14C are front, side and top views of the pair of spaced-apart, prior art, field-producing coils as shown in FIGS. 13A, B and C, but in which FIG. 14A further shows a representation of the vertical field distribution taken at a plane approximately halfway along the zone and perpendicular to the surface on which the coils are mounted;

DETAILED DESCRIPTION

Figure 1:
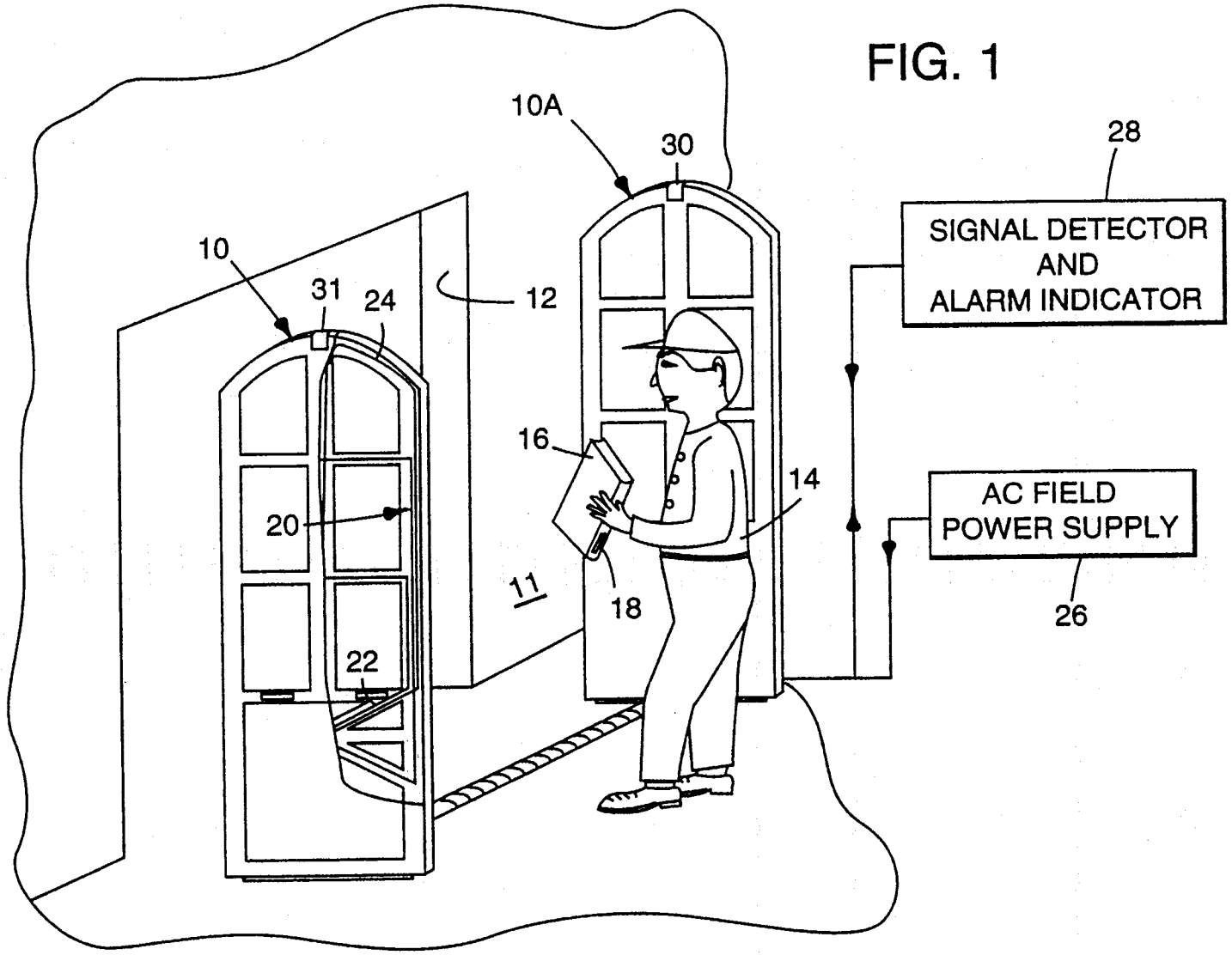
FIG. 1 is a broken away perspective view of antenna lattices containing the coil assembly of the present invention combined with a block diagram showing an associated EAS system.

FIG. 1 shows an installation of the coil assembly of the present invention as would typically be enclosed within a coil lattice and positioned adjacent an exit 12 from a secured facility such as a retail store, library or the like. As there shown, while such an installation may include a single lattice 10, most often such an installation will also include a second lattice 10A which is positioned parallel to and spaced apart from the first so as to define an interrogation zone 11 therebetween. In such a typical use, a customer, patron, etc., 14 may be detected as that person passes through the interrogation zone carrying an object 16 to which a marker 18 is attached. As shown in the broken-away part of the lattice 10, each coil assembly 20 includes a field-producing coil 22 and a detector coil 24.

Assuming that the marker 18 is in an active status, the marker will interact with fields produced by the field-producing coils within the lattices 10 and 10A, such as the coil 22, when those coils are energized by the AC field power supply 26. This, in turn, will cause the respective detector coils, such as detector coil 24, to respond such that a signal is detected by the signal detector and alarm indicator circuits 28. This, in turn, will create a suitable alarm such as may be provided by a flashing light 30 or buzzer 31 mounted on top of one or the other of the lattices.

Figure 2:
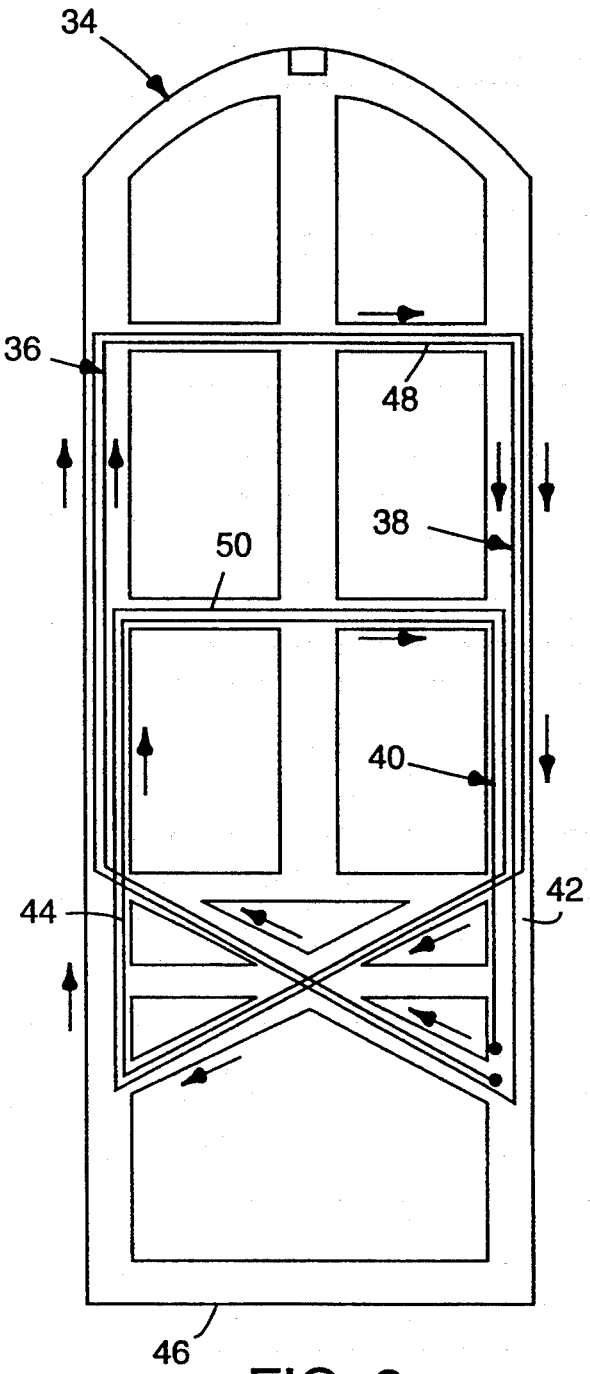
FIGS. 2 and 3 are side views of one half of the lattice shown in FIG. 1, with a field-producing coil positioned in the lattice of FIG. 2 and a detector coil positioned in the lattice of FIG. 3.

FIG. 2 shows a front view of half of a lattice 34 within which is positioned a coil assembly 36 comprising a field-producing coil 37. As there shown, the coil 37 includes two substantially similarly-shaped trapezoidal coil segments 38 and 40. The segments are juxtaposed in substantially a coplanar orientation, one of the coils being positioned as a mirror image of the other. The segment 40 is also constructed to be shorter than is the segment 38, both segments then being positioned so that the opposite longer legs 42 and 44 of each segment are equidistant from the bottom 46 of the lattice, the top horizontal sections 48 and 50 thereby being at different, predetermined heights.

As there shown for illustrative purposes, each segment 38 and 40, respectively, includes two turns, with the second turn of one segment being connected to the first turn of the other segment so that the two segments 38 and 40 are connected in series. The arrows adjacent the respective legs and sections of each segment thus show that current flows in the same direction in both top sections 48 and 50. The resultant magnetic fields reinforce each other and intensify the fields in the upper regions of the zone, enhancing the detectability of markers there positioned.

It will also be recognized that current in the oppositely-positioned diagonal portions has both a horizontal and a vertical component, and that the horizontal components, being in the same direction, add to create a stronger field which enhances the detectability of markers aligned with that field. The vertical components, on the other hand, are oppositely directed so that the fields from each partially cancel. This net weaker field is less likely to result in interference from electromagnetically sensitive objects as may be located below the surface on which the apparatus is located. In a preferred embodiment, the field coil used in this invention was configured using two trapezoidal coils with the horizontal top elements spaced 356 mm apart, with the overlapped portions of the vertical arms being 356 mm high, and vertical height of the diagonal section being 356 mm. The width of the coil was 712 mm, and was configured using six turns of six gauge litz wire.

Figure 3:
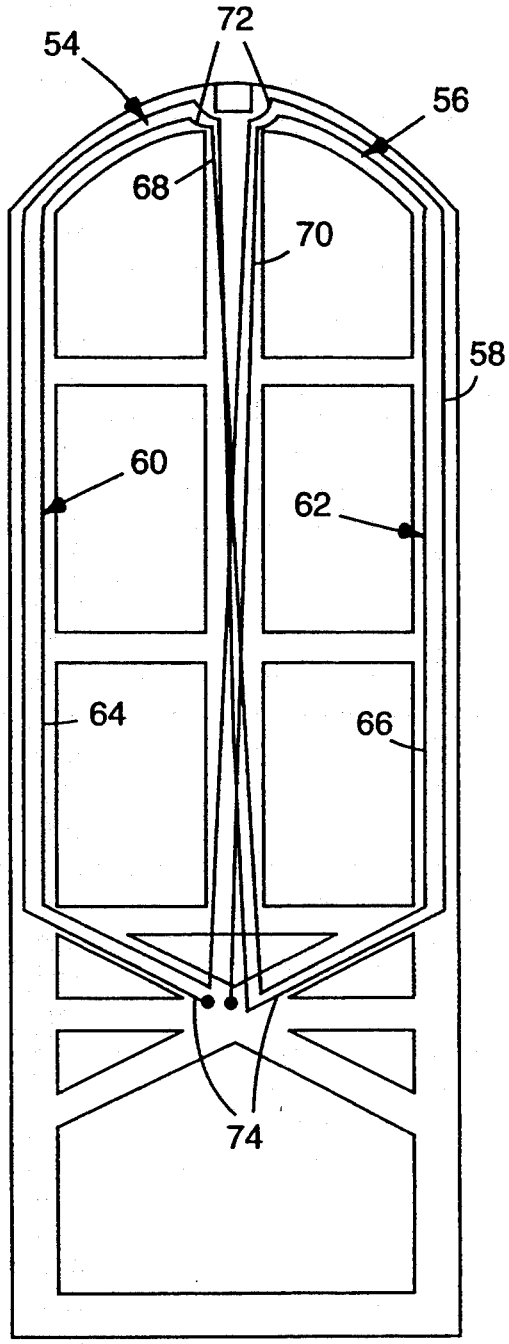

FIG. 3 further shows a front view of a lattice 54 within which is positioned a coil assembly 56 comprising a detector coil 58. While separately shown in FIG. 3 for purposes of clarity, it will be understood, as shown in FIG. 1, that a preferred coil assembly will include a detector coil positioned adjacent to and substantially coplanar with the field-producing coil. The detector coil 58 has two sections 60 and 62, which are connected in a lazy Figure-8 configuration. The coil, thus, comprises spaced-apart vertical arms 64 and 66 terminating at respective upper and lower ends at substantially the same respective levels, two center vertical arms 68 and 70 that cross over each other, and top and bottom sections 72 and 74, respectively, connecting each of the spaced-apart arms 64 and 66 to one of the center arms 68 and 70 so that the left half of the top section 72 is connected to the right half of the bottom section 74 and vice versa. Each half of the bottom section of the detector coil thus extends diagonally so as to be adjacent a respective diagonally-configured bottom section of the field-producing coil.

It will also be appreciated from that figure that the top section 72 of the detector coil extends appreciably above the topmost horizontal section of the field-producing coil so as to readily detect markers positioned in that region and which are now accessed as a result of the increased intensity field resulting from the reinforced currents flowing in both the top sections of the field-producing coil. In a preferred embodiment, the detector coil was configured as described above using one turn of 18-gauge, six-conductor instrumentation wire, in which the respective conductors were connected in series so as to create six turns. The chosen dimensions was such that the width of the coil was 715 mm, with the bottom section shaped to mirror the diagonal bottom section of the field-producing coil and the top sections extending 381 mm above the top of the topmost horizontal section of the field coil, while conforming to the top section of the lattice.

Figure 4:
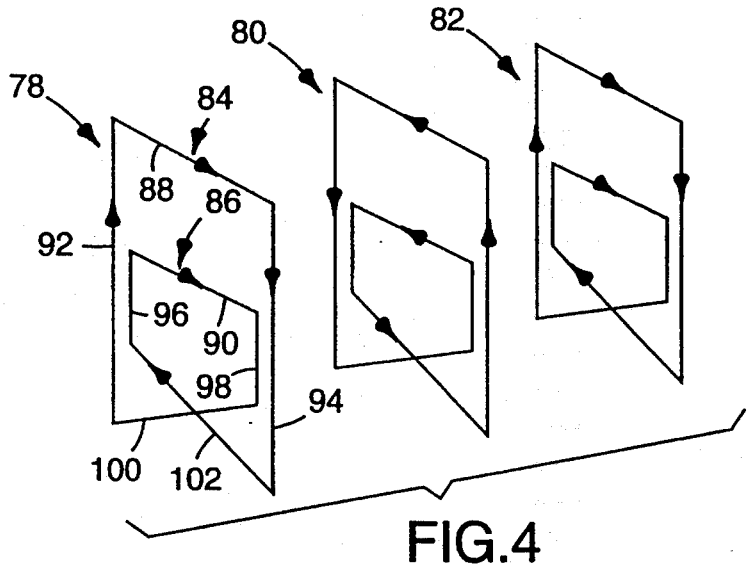
FIG. 4 is a pictorial representation of three field-producing coils as shown in FIG. 2, mutually spaced apart to provide dual parallel interrogation zones.

An exploded view of three field-producing coils 78, 80 and 82 is shown in FIG. 4, with each respective coil being spaced apart from and parallel with the others so as to define dual, parallel interrogation zones therebetween. As shown particularly with respect to coil 78, and as also shown in FIG. 2, each of the coils comprises two segments 84 and 86. Each segment has a trapezoidal shape and is positioned in a mirror image to the opposite segment. Thus, each segment 84 and 86 includes a top section 88 and 90 which are parallel to each other and are positioned at different heights so as to extend the field in an upper part of the resultant interrogation zone. Each coil further includes opposing vertical arms 92 and 94, and 96 and 98, and oppositely diagonally directed bottom legs 100 and 102. The two segments in each of the coils are preferably connected in series, and further connected so that current in the respective coils is oppositely directed in the center coil.

It will be appreciated that such oppositely-directed currents will cooperate in extending fields across the interrogation zone. Coils, as shown in FIG. 2, thereby provide zone widths of at least 914 mm, meeting the requirements of the American Disabilities Act.

Figure 5:
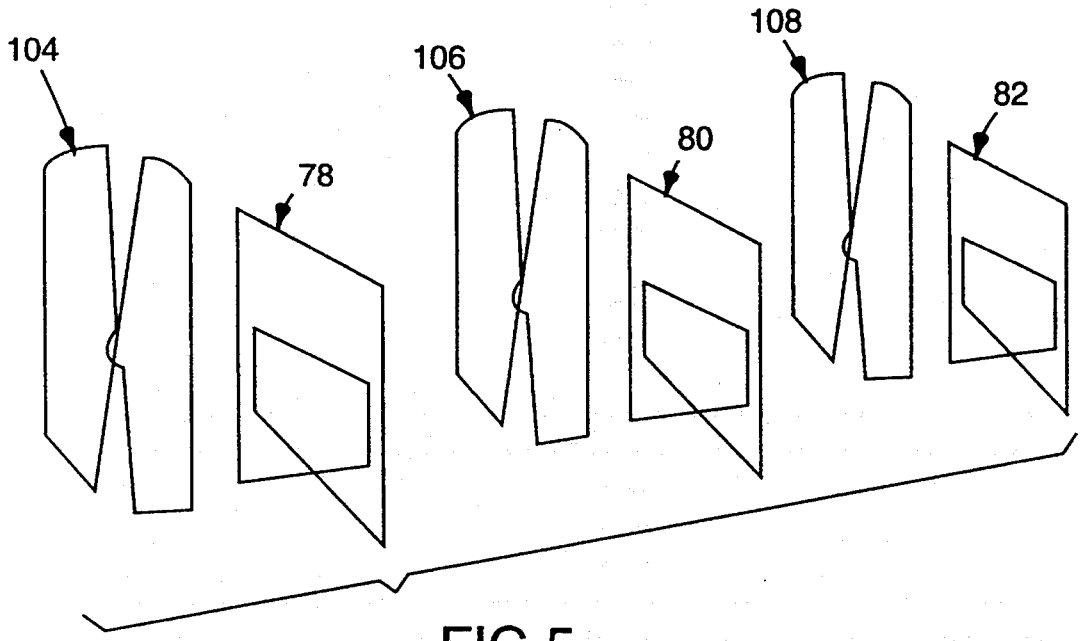
FIG. 5 is a pictorial representation of a pair of field-producing coils as shown in FIG. 2, with a detector coil, as shown in FIG. 3, shown in an exploded view adjacent to each of the field-producing coils.

The field-producing coils 78, 80 and 82 are further shown in FIG. 5, with detector coils 104, 106, and 108 respectively positioned adjacent one of the field-producing coils. The detector coils, each having the "lazy-8" configuration set forth in FIG. 3, are, in turn, connected to maximize detection in an interrogation zone having an extended width and height.

Figure 6:
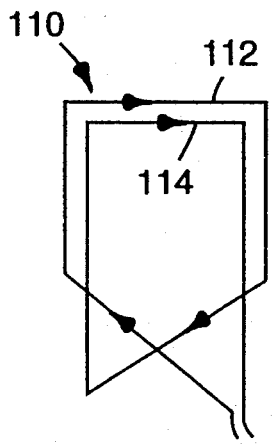
FIGS. 6–12 are pictorial representations of different embodiments of field-producing coils according to the present invention.
Figure 7:
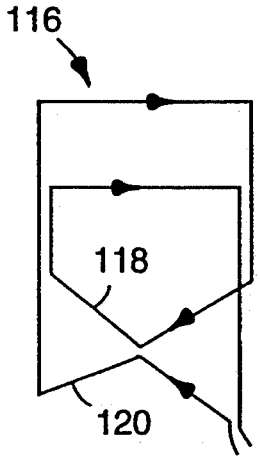

FIGS. 6 through 12 set forth various alternative configurations of the field-producing coils of the present invention. Thus, as shown in FIG. 6, in one embodiment, the coil 110 may include two segments of substantially the same size, Juxtaposed and positioned in a mirror image so that the diagonal legs are oppositely directed. In such an embodiment, the respective top sections 112 and 114 will also be juxtaposed, rather than spaced apart as in the coils previously described. From FIG. 7 it will be appreciated that the field-producing coil 112 may be constructed so that the respective bottom sections 118 and 120 rather than being straight, diagonally-positioned sections, are each angled so that a portion is downwardly directed, while another portion is upwardly directed. The segments further have the respective downward and upward directed portions of both sections extending along a common line.

Figure 8:
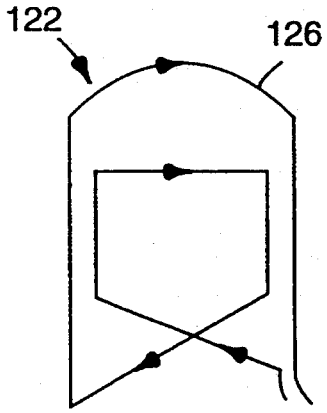
Figure 9:
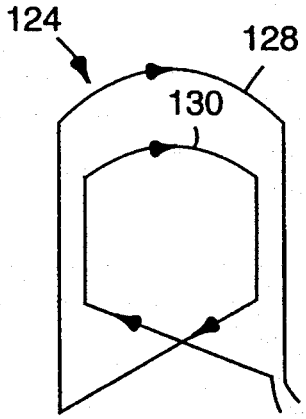
Figure 10:
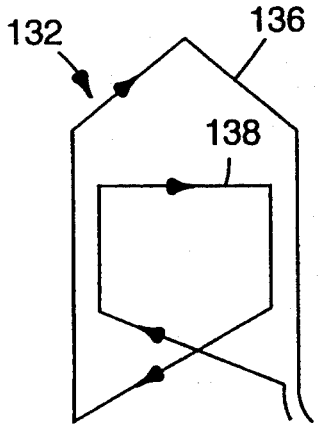
Figure 11:
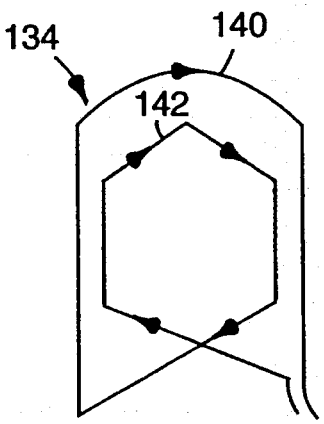
Figure 12:
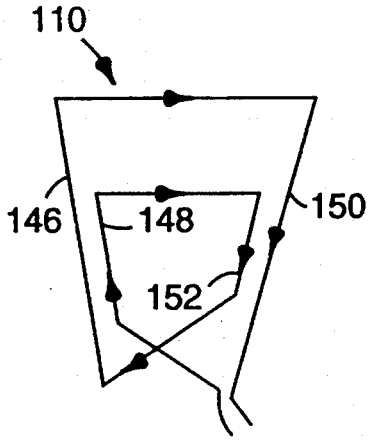

It will also be recognized that the coil may have other than straight top sections. FIGS. 8 and 9 show embodiments in which the coils 122 (FIG. 8) and 124 (FIG. 9) have one or both of the top sections 126, 128 and 130 curved, as might be desired to correspond with the overall shape of a detection coil included in the assembly. Similarly, FIGS. 10 and 11 represent embodiments in which the coils 132 and 134 have segments in which one or more of the respective top sections 136, 138, 140 and 142 are straight, with oppositely angled portions. Finally, as shown in FIG. 12, it will also be recognized that the coil 144 may have segments in which the juxtaposed arms 146 and 148, and 150 and 152, while being substantially vertical, diverge or converge. Other variants are likewise within the scope of the invention.

The improved field distribution provided by the coil assembly of the present invention is particularly evident in FIGS. 13, 14, 15 and 16. FIG. 13 represents a pair of spaced-apart, field-producing coil assemblies of the prior art, with FIG. 13A showing a cross section of an interrogation zone, 13B showing a side view, and 13C showing a top view. FIG. 13B thus shows but one of the coil assemblies 154, the other being positioned directly behind it. The assembly 156 includes two substantially square sections 156 and 158 positioned so that the respective vertical arms are aligned, and with the horizontal sections offset so that the bottom horizontal section of the top section 156 intersects the mid-point of the lower section 158. (Such a configuration is set forth in U.S. Pat. No. 4,623,877, albeit in a form in which two coil segments of equal width are provided, one segment, one-third the height of the other, being centered within the other.) The top view of FIG. 13C further clarifies the location of the other coil assembly 160, including like-segments 162 and 164, spaced apart from the assembly 154 so as to define the interrogation zone therebetween.

The entrance into the zone in each of the FIGS. 13B and C is indicated by the arrow 166. A plane proximate to the entrance, represented in those views as E—E, is shown in FIG. 13A together with representative field distribution lines. With current flowing in the same direction in the respective top and bottom horizontal sections of each segment, and in the opposite direction in the coils on opposite sides of the zone, it will be seen that the field patterns generated by such a coil and current configuration is such that the vertical field component is symmetric with respect to the top and bottom horizontal coil elements, with that in the bottom elements being in opposing direction. The cancellation of the bottom vertical field with the top vertical field occurs at the geometric center of the combined assembly. The bottom vertical field below the coil is the same as that extending above the top pair of coils. Also, the field density occurring at the plane E—E, and likewise at a similarly positioned plane at the exit from the zone, is essentially the minimum vertical pattern existing anywhere in the zone.

FIGS. 14A–C represent substantially the same coil and current configuration as that discussed in conjunction with FIGS. 13A–C, but differ in that the view shown in FIG. 14A is taken along a plane C—C, proximate a distance halfway along the corridor. With the same current flowing in the coils, it will be seen from FIG. 14A that the vertical field component is still symmetric with respect to the top and bottom horizontal coil sections. The cancellation of the bottom vertical field with the top vertical field again occurs at the geometric center horizontal plane of the assembly. And, as the vertical field below the assembly is still the same as the vertical field extending above the top of the assembly, interference from electromagnetically active objects, such as reinforcing rods below the floor, etc., may occur. The vertical field density occurring at the plane C—C in the corridor is the maximum occurring anywhere along the corridor.

In contrast to the prior art coil assembly discussed in conjunction with FIGS. 13 and 14, FIGS. 15 and 16 represent front, top and side views of coil assemblies according to the present invention, and, in particular, correspond to the single corridor, trapezoidal assemblies shown in FIG. 1. Thus, as seen in FIG. 15B, one assembly 167 includes segments 168 and 170, and as further shown in FIG. 15C, the other assembly 172 includes segments 174 and 176.

Figure 15C:
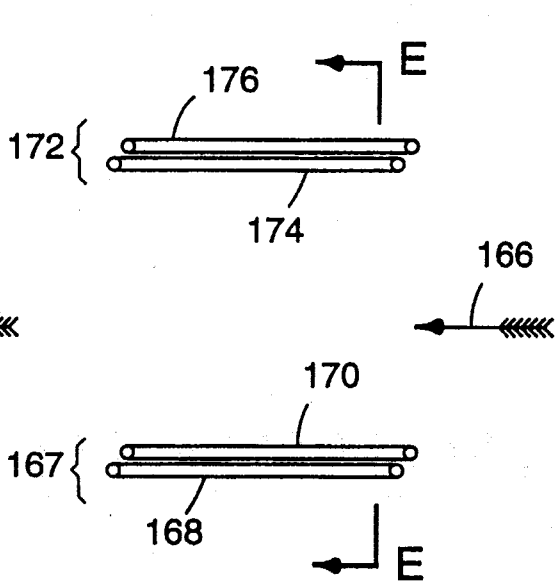
FIGS. 15A, 15B, and 15C are front, side and top views of a pair of field-producing coils according to the present invention as shown in FIG. 2, spaced apart to define an interrogation coil therebetween in which FIG. 15A further shows a representation of the vertical field distribution taken at a plane approximately at the entrance to the interrogation zone and perpendicular to the surface on which the coils are mounted.
Figure 15B:
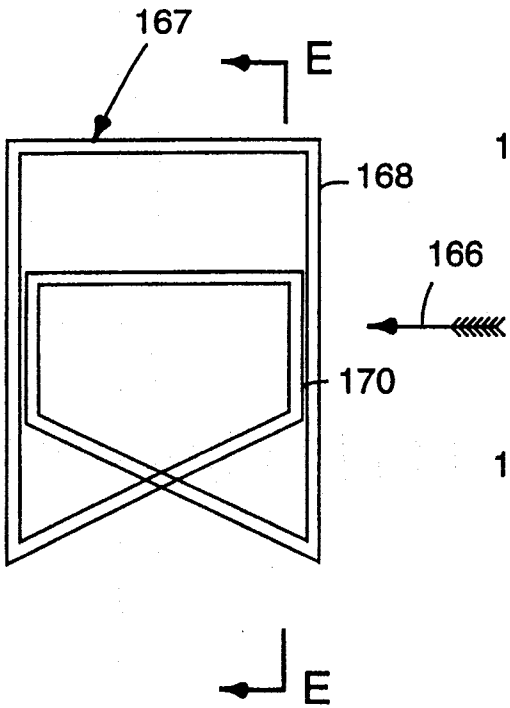
Figure 15A:
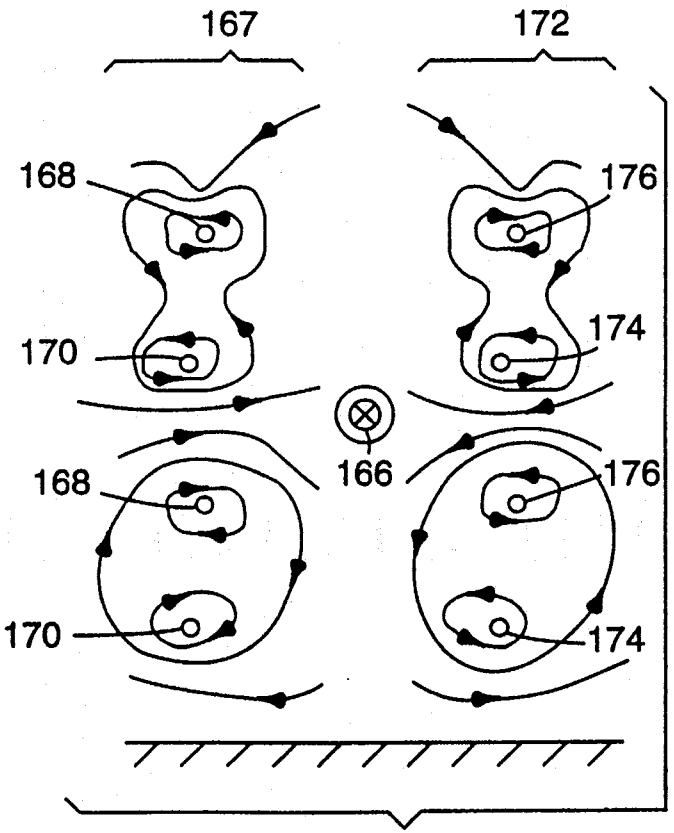

As seen in the edge view of FIG. 15A taken at the plane E—E proximate to the entrance of the zone, and with substantially the same coil and current configurations as shown in FIG. 4, the field patterns are such that the cancellation of the vertical field components in the lower portion of the zone are minimized due to the smaller vertical field resulting from the opposing diagonal elements. (Compare FIGS. 13A and 15A.) In contrast, the vertical field adjacent to the upper horizontal elements is slightly increased over that shown in FIG. 13A. Preferably, marker detection is still further enhanced thereover by the use of extended height detector coils, as shown in FIG. 3 in both the left and right coil assemblies.

Figure 16C:
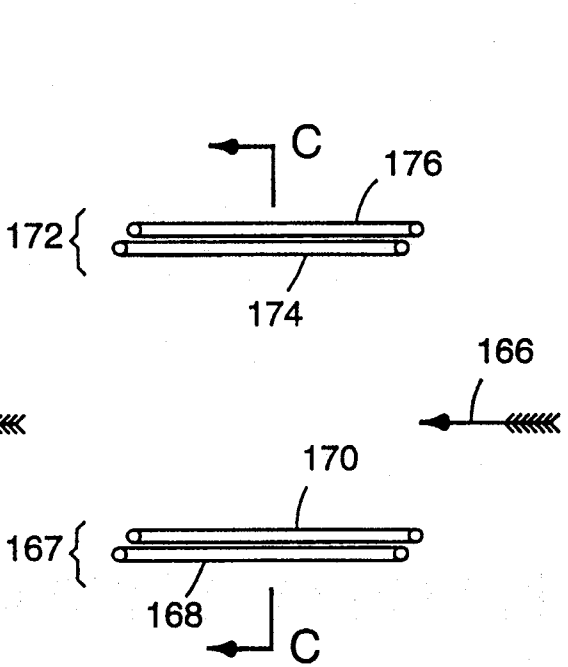
FIGS. 16A, 16B, and 16C are front, side and top views of the pair of field-producing coils according to the present invention, in which FIG. 16A further shows a representation of the vertical field distribution taken at a plane approximately halfway along the interrogation zone and perpendicular to the surface on which the coils are mounted.
Figure 16B:
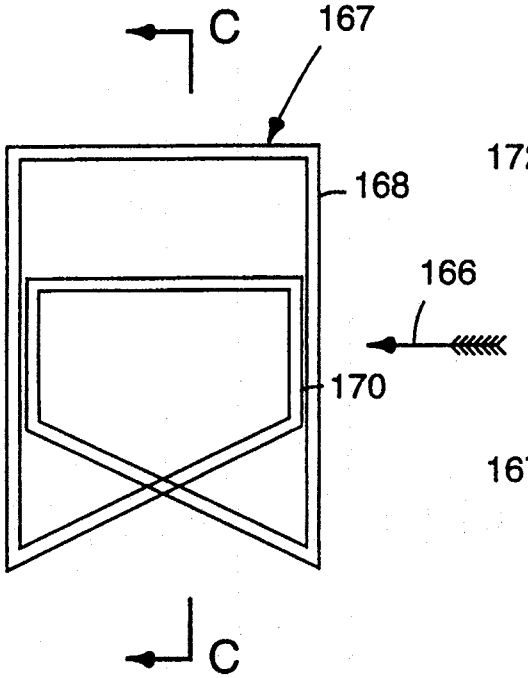
Figure 16A:
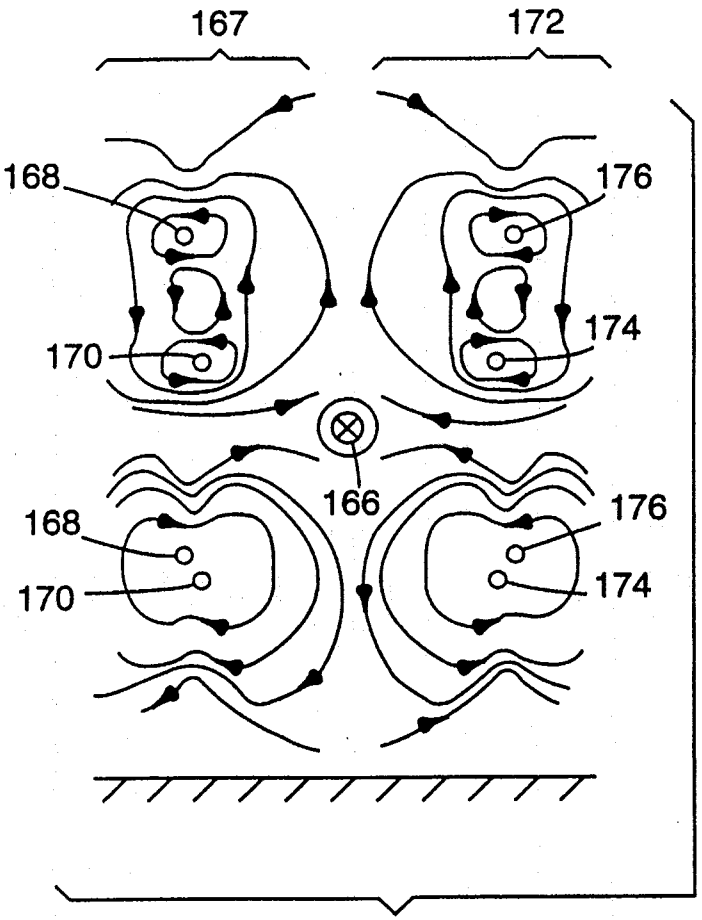

Finally, with regard to FIGS. 16A–C, substantially the same coil and current configuration as that discussed in conjunction with FIGS. 15A–C were used, but differ in that the view shown in FIG. 16A is taken along a plane C—C proximate the center of the zone. With the same current flowing in the coils, it will be seen from FIG. 16A that the vertical field component is still symmetric with respect to the top horizontal coil sections, again in opposite directions in the respective right and left coil assemblies. The cancellation of the bottom vertical field with the top vertical field now occurs at a lower level. And below that level, where the lower diagonal elements are at a crossover point, a high density field pattern is created. The effect of this imbalance is to extend the vertical field, thus, maximizing the detectable area in the upper half of the zone. And, importantly, the lower vertical area is also smaller and thereby creates a smaller external field, thus lessening adverse effects from external sources such as those as may be located below the floor. The vertical field density occurring at the plane C—C is the maximum occurring anywhere along the corridor. Overall, coverage in the upper vertical field is maximized, and the external field in the lower half is minimized, thus lessening external interference.

What is claimed is:

1. A coil assembly for an electronic article surveillance (EAS) system, the assembly comprising a field-producing coil which includes at least a pair of coil segments juxtaposed in substantially a coplanar orientation, each segment having i) a pair of spaced apart arms;

ii) a top section connecting upper ends of the arms; and iii) a bottom, at least partially diagonal section connecting a lower end of one of the arms to a lower end of one of the arms of the other segment;

wherein the bottom sections of each segment are at substantially the same level and are positioned at opposite diagonal angles with respect to each other, and further wherein the segments are connected such that current applied thereto is additive in the top sections and intensifies a resultant magnetic field in the upper half of the coil assembly and thus enhances the detectability of EAS markers located proximate thereto, and such that a magnetic field resulting from current in the diagonally positioned bottom sections at least partially cancels and thus minimizes interference from electromagnetically active objects proximate a surface on which the EAS system may be positioned.

2. A coil assembly according to claim 1, wherein the respective top sections of each segment are located at a different, predetermined height so as to produce a vertically extended magnetic field in the upper half of the coil assembly to enhance the detectability of EAS markers located in the upper half of the interrogation zone.

3. A coil assembly according to claim 1, wherein the arms of each segment are parallel to each other.

4. A coil assembly according to claim 3, wherein each of the coil segments are substantially trapezoidal.

5. A coil assembly according to claim 1, wherein the bottom, diagonal section of each segment is formed to be substantially straight.

6. A coil assembly according to claim 1, wherein the current in the bottom section of each segment has a horizontal component and a vertical component.

7. A coil assembly according to claim 6 wherein the horizontal components of the current in the bottom sections are like directed and wherein the vertical components of the current in the bottom sections are oppositely directed.

8. A coil assembly according to claim 1, wherein at least one of the top sections is configured in a generally arch shape.

9. A coil assembly according to claim 1, further comprising a detector coil positioned adjacent to and substantially coplanar with the field-producing coil, said detector coil having two sections connected in a lazy Figure-8 configuration.

10. A coil assembly according to claim 9, wherein said detector coil comprises spaced apart arms terminating at respective upper and lower ends at substantially the same respective levels, two center arms that cross over each other, and top and bottom sections connecting each of the spaced apart arms to one of the center arms so that a left half of the top section is connected to the right half of the bottom section and vice versa, each half of the bottom section of the detector coil extending diagonally so as to be adjacent a respective diagonally configured bottom section of the field-producing coil.

11. A coil assembly according to claim 9, wherein the top section of the detector coil extends above the top section of the field-producing coil so as to detect fringe fields extending above the field-producing coil.

12. A coil assembly according to claim 1, further comprising a second field-producing coil positioned parallel to and spaced apart from the first field-producing coil to define a first interrogation zone of an associated EAS system therebetween.

13. A coil assembly according to claim 12, further comprising means for connecting the first and second field-producing coils so that current flows in opposite directions in the corresponding sections of each coil when viewed from the same side of the interrogation zone.

14. A coil assembly according to claim 12, further comprising a third field-producing coil positioned parallel to and spaced apart from the second field-producing coil to define a second interrogation zone parallel to the first interrogation zone.

15. A coil assembly according to claim 14, further comprising means for connecting the third field-producing coil so that current flows in opposite directions in the corresponding sections of the third coil from that flowing in the second coil.

16. A coil assembly according to claim 12, further comprising first and second detector coils, each detector coil being positioned adjacent to and substantially coplanar with one of the field-producing coils and having two sections connected in a lazy Figure-8 configuration.

17. A coil assembly according to claim 16, wherein each detector coil comprises spaced apart arms terminating at respective upper and lower ends at substantially the same respective levels, two center arms that cross over each other, and top and bottom sections connecting each of the spaced apart arms to one of the center arms so that a left half of the top section is connected to the right half of the bottom section and vice versa, each half of the bottom section of the detector coil extending diagonally so as to be adjacent a respective diagonally positioned bottom section of the field-producing coil and the top section of the detector coil extending appreciably above the top section of the field-producing coil so as to detect fringe fields resulting from the field-producing coil.

18. A coil assembly according to claim 1 wherein the arms of one of the segments are of a first length and the arms of the other segment are of a second, different length.

19. A coil assembly according to claim 18 wherein the upper ends of the arms of one of the segments are at a first level and the upper ends of the arms of the other segment are at a second, different level, such that the top section of one of the segments is at a different level than the top section of the other segment.

* * * * *